US006030762A

United States Patent [19]

Verrept et al.

[11] Patent Number: 6,030,762

[45] Date of Patent: Feb. 29, 2000

[54] METHOD OF PREPARING {111} TABULAR SILVER CHLORO(BROMO)IODIDE CRYSTALS

[75] Inventors: Peter Verrept, Avelgem; Ann Verbeeck, Begijnendijk, both of Belgium

[73] Assignee: Agfa-Gevaert, N.V., Mortsel, Belgium

[21] Appl. No.: 09/042,466

[22] Filed: Mar. 16, 1998

Related U.S. Application Data

[60] Provisional application No. 60/045,086, Apr. 29, 1997.

[30] Foreign Application Priority Data

Mar. 19, 1997 [EP] European Pat. Off. ..... 97200812

[51] Int. Cl.[7] ..... G03C 1/035; G03C 1/07

[52] U.S. Cl. ..... 430/567; 430/569

[58] Field of Search ..... 430/567, 569

[56] References Cited

U.S. PATENT DOCUMENTS

| | | | |
|---|---|---|---|
| H001323 | 6/1994 | Ohezeki et al. | 430/569 |
| 5,176,991 | 1/1993 | Jones et al. . | |
| 5,183,732 | 2/1993 | Maskasky . | |
| 5,525,460 | 6/1996 | Maruyama et al. | 430/569 |

*Primary Examiner*—Janet Baxter
*Assistant Examiner*—Amanda C. Walke
*Attorney, Agent, or Firm*—Breiner & Breiner

[57] ABSTRACT

A method has been found of preparing a silver halide emulsion comprising silver chlorobromoiodide or silver chloroiodide tabular grains with at least 75 mole % of chloride and from 0.1 up to 3 mole % of iodide, based on silver, further having {111} crystal faces, an average aspect ratio of at least 2:1, with at least 50%, more preferable at least 75% and still more preferable more than 90% of the total projected area of all grains being provided by said tabular grains and with a variation coefficient on sphere equivalent diameter (SED) of said grains being lower than 0.30, more preferably lower than 0.25 and most preferable from 0.05 up to at most 0.15, said method comprising the steps of preparing a dispersion medium (preferably containing a gelatino-peptizer) and a crystal habit growth modifier in a reaction vessel;

precipitating silver chlor(oiod)ide or silver chlorobrom (oiod)ide nuclei in a crystal nucleation step by mixing silver salt and halide salt solutions in the said dispersion medium, growing the said nuclei during one or more growth and/or physical ripening steps;

characterized by maintaining the said dispersion medium at an initial pH value maintained between 6.0 and 9.0 during nucleation;

setting pH to a value lower than 6.0, and more preferably to a value of not more than 4.0, for at least 30 seconds, between ending the said nucleation step and ending the said growing step; followed by resetting pH to the said initial pH value.

19 Claims, 1 Drawing Sheet

METHOD OF PREPARING {111} TABULAR SILVER CHLORO(BROMO)IODIDE CRYSTALS

This application claims the benefit of U.S. Provisional Application Ser. No. 60/045,086 filed Apr. 29, 1997.

DESCRIPTION

1. Field of the Invention

The present invention relates to the preparation of tabular silver halide emulsion grains rich in silver chloride showing enhanced monodispersity in grain size and to a method of controlling thickness of said grains.

2. Background of the Invention

Tabular silver halide grains are well-known for practical use since the early eighties as crystals possessing two parallel faces with a ratio between the diameter of a circle having the same area as these faces, and the thickness, being the distance between the two major faces, equal to two or more. In a number of US-A's filed in 1981 and issued in 1984 tabular grains with high aspect ratio and their advantages in photographic applications are described as in U.S. Pat. Nos. 4,434,226 (high aspect ratios of more than 8:1); 4,439,520 (specifically about spectral sensitization); 4,425,425 (radiographic materials containing tabular grains with an aspect ratio of at least 8:1) and 4,425,426 (similar grains having an aspect ratio between 5:1 and 8:1). A survey on high aspect ratio silver halide emulsions appeared in Research Disclosure, Volume 225, Jan 1983, Item 22534.

For radiographic applications the main photographic advantages of tabular grains compared to normal globular grains are a high covering power at high forehardening levels as described in U.S. Pat. No. 4,414,304, a high developability and higher sharpness especially in double side coated spectrally sensitized materials thereby lowering of cross-over as specifically described in U.S. Pat. Nos. 4,425,425 and 4,425,426.

In the references on {111} tabular grains cited above especially silver bromide or silver iodobromide emulsions having a high sensitivity are disclosed, although it has been shown that high speed can also be achieved with tabular silver halide grains rich in silver chloride as in EP-A 0 678 772.

For the said {111} tabular silver halide grains rich in silver chloride use of a crystal habit modifier in relatively high amounts is required, as has been illustrated in U.S. Pat. Nos. 4,713,323; 4,804,621; 5,176,692; 5,183,732; 5,185,239; 5,252,452; 5,286,621; 5,298,385 and 5,298,388.

Treatment with iodide of tabular grain emulsions having {111} crystals rich in chloride in order to get an enhanced morphological stability and enhanced photographic performance has been disclosed in EP-A 0 678 772 and Research Disclosure No. 388046, published Aug. 1, 1996.

However as a global result fairly heterogeneous crystal distributions are obtained: a common variability coefficient (defined as a ratio between average standard deviation on equivalent circular diameter and the said average equivalent circular diameter) of 0.30 to 0.45 is calculated, due to the presence of quite a large number of non-tabular grains having a sphere equivalent diameter of less than 0.3 $\mu$.

Such a high degree of heterodispersity leads to e.g. uncontrolled chemical and spectral sensitisation, lower contrast and lower covering power, thereby loosing typical advantages of the said grains as referred to hereinbefore.

Until now efforts in order to get more monodisperse tabular silver halide crystal distributions in emulsion preparation have been directed towards silver halide crystals rich in silver bromide as has e.g. been described in U.S. Pat. Nos. 4,797,354; 5,147,772; 5,147,773; 5,171,659; 5,248,587; 5,204,235; 5,210,013; 5,215,879; 5,250,403; 5,252,453; 5,254,453; 5,318,888; 5,439,787; 5,472,837; 5,482,826 and 5,484,697.

However no controll of thickness of the said tabular grains rich in silver chloride during emulsion precipitation was hitherto possible. One important disadvantage resulting therefrom is the occurrence of an unpredictable image tone.

Radiographic materials comprising emulsions having monodisperse tabular silver brom(oiod)ide crystals have e.g. been described in U.S. Pat. Nos. 5,252,442 and 5,508,158. The same preparation methods as for the forementioned tabular grains rich in silver bromide can however not be applied as such in preparing tabular grains rich in silver chloride, especially due to the presence of crystal habit modifiers, usually adenine, as this leads to the disadvantages set forth hereinbefore.

OBJECTS OF THE INVENTION

Therefore it is a first object of the present invention to improve the monodispersity of the crystal distribution of tabular silver halide grains rich in silver chloride, particularly by avoiding the presence of disturbing fine grains in the grain distribution in order to make sensitometry, image quality and image tone of the processed material comprising the said grains in dispersed form more constant and predictable.

It is a second object of the present invention to get a method of making grain thickness of the said tabular silver halide grains rich in chloride more predictable.

It is a third object of the present invention to offer the possibility of coating lower amounts of silver, thereby reducing amounts of processing chemicals and waste material after processing in ecologically justified circumstances related with ecological hardener free processing solutions, rapid processing, low regeneration, etc..

Other objects will become apparent from the description hereinafter.

SUMMARY OF THE INVENTION

In order to reach the objects of the present invention set forth hereinbefore a method has been found of preparing a silver halide emulsion comprising silver chlorobromoiodide or silver chloroiodide tabular grains with at least 75 mole % of chloride and from 0.1 up to 3 mole % of iodide, based on silver, further having {111} crystal faces, an average aspect ratio of at least 2:1, with at least 50%, more preferable at least 75% and still more preferable more than 90% of the total projected area of all grains being provided by said tabular grains and with a variation coefficient on sphere equivalent diameter (SED) of said grains being lower than 0.30, more preferably lower than 0.25 and most preferable from 0.05 up to at most 0.15, said method comprising the steps of preparing a dispersion medium and a crystal habit growth modifier in a reaction vessel;

precipitating silver chlor(oiod)ide or silver chlorobrom(oiod)ide nuclei in a crystal nucleation step by mixing silver salt and halide salt solutions in the said dispersion medium, growing the said nuclei during one or more growth and/or physical ripening steps;

characterized by maintaining the said dispersion medium at an initial pH value between 6.0 and 9.0 during the said crystal nucleation step;

setting pH to a value lower than 6.0, and more preferably not more than 4.0, for at least 30 seconds, between ending the said nucleation step and ending the said growing step; followed by resetting pH to the said initial pH value.

DETAILED DESCRIPTION

Figure 1:
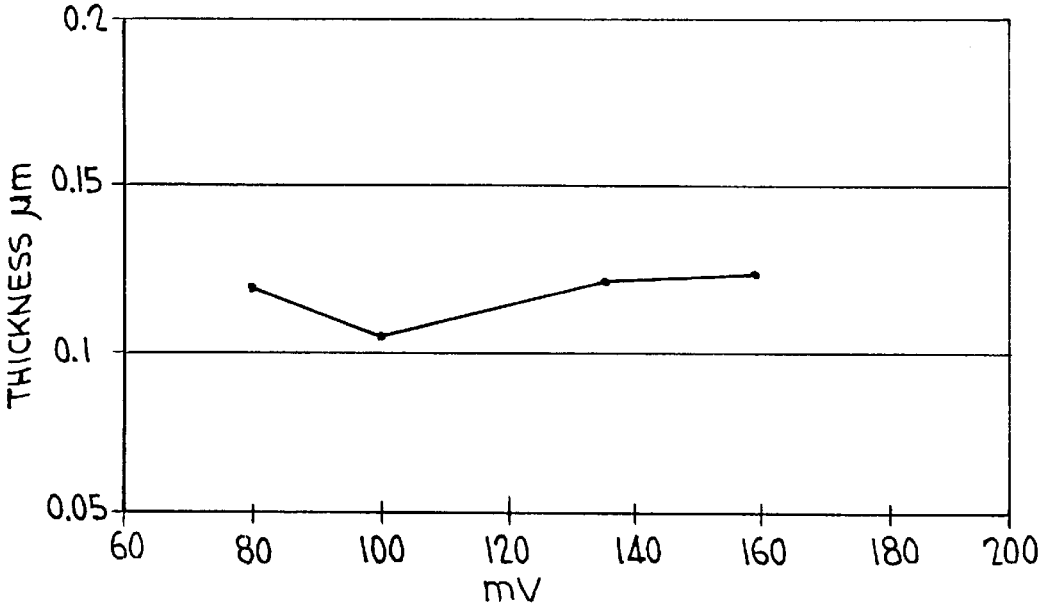

Preparation methods of silver halide tabular {111} grains have been disclosed e.g. in U.S. Pat. No. 5,286,621 and in EP-A's 0 481 133 and 0 678 772. As has been shown in FIG. 1 hereinafter, it is impossible to get a predictable thickness of tabular {111} silver halide grains rich in chloride as a function of differing values of UAg in the range between 80 mV and 160 mV versus a saturated silver/silver chloride electrode during the nucleation step in the preparation method according to EP-A 0 481 133.

According to the present invention a method has unexpectedly been found in order to make thickness of the tabular {111} silver chloroiodide or silver chlorobromoiodide grains perfectly predictable, wherein an essential step is the lowering of the initial pH value after nucleation by setting it to a value of lower than 6.0, more preferred to a value of not more than 4.0 for at least 30 seconds, followed by resetting pH to the said initial pH. This "setting of the pH value" completely differs from pH correction or pH adjustment due to spontaneous pH lowering which may take place during running an aqueous acidic solution of silver nitrate in a double jet precipitation step, thereby causing pH decrease in the reaction vessel to a value lower than the said initial pH value has e.g. been described in Example 15B from U.S. Pat. No. 5,183,732. In the said Example a pH adjustment was performed in order to maintain the initial pH value in the reaction vessel by addition of an alkaline solution of sodium hydroxide.

In one embodiment the said lowering in the sense of intended setting of pH to a lower value immediately occurs after ending nucleation, during a physical ripening step following the said nucleation, during a physical ripening step inbetween one or more growth steps, during growth or at the end of growth, but before flocculation or ultrafiltration, wherein said ultrafiltration may be performed off-line or on-line. During performing said ultrafiltration spectral sensitizing dye(s) may be added. It may further be useful to perform said essential step wherein pH is lowered more than once within the period after nucleation but before flocculation or ultrafiltration.

Although the presence of a crystal habit modifier, required in order to get tabular {111} silver halide grains rich in chloride is not always in favour of reproducibility, the preparation conditions of tabular grains rich in silver chloride have now been adapted in order to overcome problems of unreproducibility and morphological instability of the tabular silver halide grains rich in chloride as well. The said morphological instability is particularly reflected in the occurrence of a rounded edges after the disappearance of sharp, well-defined edges of hexagons and triangles, which is recognized as a disadvantage.

Compounds that are useful as crystal habit modifier of crystals rich in silver chloride include substances disclosed in EP-A's 0 481 133 and 0 532 801 and in U.S. Pat. Nos. 5,176,991; 5,176,992; 5,178,997; 5,178,998; 5,183,732; 5,185,239; 5,217,858; 5,221,602; 5,252,452; 5,264,337; 5,272,052; 5,298,385; 5,298,387; 5,298,388; 5,399,478; 5,405,738; 5,411,852 and 5,418,125.

According to the method of the present invention the crystal habit growth modifier used has a chemical structure according to the formula Ia or Ib, wherein:

(Ia)

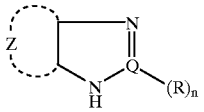

(Ib)

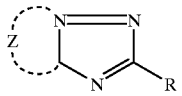

Z represents the atoms necessary to form a fused or aromatic carbocyclic or heterocyclic, unsubstituted ring or ring substituted with alkyl, alkenyl, aryl, alkoxy, hydroxy, mercapto, carboxy or halogen, and R is hydrogen or a substituent as defined for ring Z;

n is 0 or 1; and

Q represents carbon when n=1, or nitrogen when n=0.

According to the method of the present invention as a crystal habit growth modifier adenine is the most preferred, said modifier being representative as an example of the presented 2-hydro-amino-azines.

Application of the method according to the present invention set forth hereinbefore makes the said tabular grains quite easily account for at least 75% of the total projected area of all grains. In a more preferred embodiment in favour of homogeneity of the crystal distribution the said tabular grains even account for at least 90% of the total projected area of all grains. Said grains preferably have an average crystal diameter of from 0.3 to 3.0 $\mu$m, more preferred from 0.5 to 2.5 $\mu$m and still more preferred from 0.5 to 1.5 $\mu$m, for an average thickness of the tabular grain from at least 0.05 $\mu$m up to at most 0.50 $\mu$m, more preferred from 0.05 to 0.35 $\mu$m and still more preferred from 0.05 to 0.20 $\mu$m. Average aspect ratios of the tabular grains obtained after calculation from the ratio of diameter to thickness measured for each grain are in the range 2:1 to 100:1, more preferred from 5:1 to 50:1 and still more preferred from 5:1 to 20:1 or even from 8:1 to 20:1.

Crystal distributions wherein the said variation coefficient on sphere equivalent diameter (SED) of all grains is less than 0.25 and more preferably from 0.05 up to 0.15 are attained for the {111} tabular silver chlorobromoiodide or silver chloroiodide emulsions prepared according to the method of the present invention.

It is clear from the description hereinbefore that the determining step in the method of the present invention after the precipitation of silver chlor(oiod)ide or silver chlorobrom(oiod)ide nuclei in a dispersion medium having an initial pH value maintained between 6.0 and 9.0 during nucleation is the setting after the said nucleation step of pH to a value of lower than 6.0 for at least 30 seconds, and more preferably to a value of not more than 4.0, followed by resetting pH to the said initial pH.

By introducing this pH-lowering step a perfect controll of grain thickness and homogeneity of the grain size distribution is performed. The value to which the pH is lowered (normally to a value of 4.0 or even 3.0, although lower values are not excluded) is therein decisive for the average end thickness of the grains: a lower pH leads to an increased average thickness, which may be preferred, depending on the applications wherein said grains are used.

Furthermore not only the degree of lowering the pH is determining the end value of the average thickness of the tabular grains but also the time during which this pH value is held constant at the lower pH value: changing this time offers the opportunity of controlling the thickness growth of the tabular silver chloro(bromo)iodide grains obtained. It is clear that also the time required to change pH by addition of acidic solutions like e.g. sulphuric acid or hydrochloric acid should be carefully controlled, as well as the time required to reset the pH to higher values between 6.0 and 9.0.

According to the present invention in another embodiment lowering of pH is performed during physical ripening steps in between the growth steps. In a more preferred embodiment said pH adjustment is performed during the first physical ripening step (after nucleation) before any growth step has been carried out. In still another embodiment said pH adjustment is carried out during precipitation or growth, thus while silver and halide salt solutions are running.

Preparation methods of tabular grains having a {111} crystal habit are normally characterized by the presence of a nucleation step, wherein preferably up to at most 10% of the total amount of silver salt in a diluted medium having a concentration of at most 0.03 molar is consumed at a constant temperature between 35° C. and 55° C., other temperature intervals however not being excluded. If iodide is present a concentration of not more than 0.5% is preferred in the nucleation step in order to prevent formation of nuclei in an excessive amount. Although bromide may be present in the nucleation step if silver chlorobromoiodide crystals are prepared, its absence is preferred and chloride present therein in an amount of at least 99.5% is commonly occurring. One or more growth steps, with at least one physical ripening step inbetween, are normally following said nucleation step.

In order to provide enough silver and halide ions proportional with the growing rate of the growing crystal surface it is advantageous to accelerate the addition rate of silver and halide salts as a function of time. Also from an economical point of view this measure is advantageous as this is a time saving procedure. In combination therewith the growing volume in the reaction vessel, leading to an increased dilution of emulsion crystals in the reaction vessel, may be held constant by removing excessive amounts of soluble alkaline nitrates and of water by means of dialysis and/or ultrafiltration.

According to the method of the present invention growing the said nuclei is performed by double jet precipitation, wherein iodide salt solutions are optionally present in the said halide salt solutions essentially consisting of chloride salts and optionally of bromide salts characterized further by maintaining the said chloride salts in the reaction vessel at a constant concentration of less than 0.15 M.

During said growth step(s) nuclei are thus further grown by double jet precipitation, wherein the rest of the total amount of silver is consumed and wherein iodide salts are optionally present in halide salt solutions (normally as alkali iodide solution in an alkali chloride solution, wherein chloride salts are present in excessive amounts versus iodide salts) essentially consisting of chloride salts and optionally of bromide salts (if silver chlorobromoiodide crystals are prepared) and wherein a chloride ion concentration of less than 0.15 M is maintained.

It is clear that during the nucleation and following physical ripening step, a ratio of gelatin, if used as protective hydrophilic colloid binder, to silver, expressed as an equivalent amount of silver nitrate, of about 5 is calculated, which is rather high. Said ratio, also called "gesi" decreases during the following growth steps to a value of about 0.3. During physical ripening an increase of the temperature of the reaction vessel to about 70° C. is normally performed during a time of about 20 minutes in order to hold said temperature at the same value during growth of the tabular grains. Preferably pH remains at the same value of about 6.0 (wherein said expression "about" takes into account that during running aqueous acidic silver nitrate solutions, pH will spontaneously decrease slightly up to e.g. about 0.2 pH units) unless, according to the present invention during this specific physical ripening step the setting or adjusting of pH to a value of lower than 6.0, and more preferably of not more than 4.0, for at least 30 seconds is performed, followed by resetting pH to the said initial pH, in order to controll thickness of the grains and the homogeneity of the crystal size distribution (expressed as equivalent volume diameter) to a value of the variation coefficient of less than 0.30, more preferably to a value of from 0.05 to at most 0.25 and still more preferably to a value of from 0.05 up to at most 0.15 as set forth hereinbefore.

During this step pAg further commonly decreases to a value between 6.5 and 7.0 or a corresponding value of about 135 mV versus a silver/silver chloride reference electrode.

In thin tabular silver chlorobromoiodide or silver chloroiodide emulsions comprising iodide in an amount of from 0.1 mole % up to 3 mole %, the halide distribution in the tabular grains is homogeneous or heterogeneous over the whole crystal volume. When phases differing in silver halide composition are present over the crystal volume said crystal is said to have a core-shell structure. More than one shell can be present and between different phases it can be recommended to have a phase enriched in silver iodide by applying the so-called conversion technique during preparation.

In a preferred embodiment, according to the method of the present invention, during and/or after growing the said nuclei at least one conversion step is performed, wherein converting the said emulsion grains is performed by adding inorganic iodide salts and/or organic iodide releasing compounds to the reaction vessel.

In another embodiment during and/or after growing the said nuclei at least one conversion step is performed, wherein converting the said emulsion grains is performed by adding silver iodide microcrystals having an average crystal size of at most 0.05 $\mu$m.

According to the method of the present invention silver chlorobromoiodide or silver chloroiodide emulsions are thus prepared by converting the said emulsion grains so that the said emulsion comprises tabular grains having a variable iodide profile, in that the grains have been enriched in iodide at the crystal surface, said profile being characterized by the presence of iodide ions in the crystal volume in lower amounts than at the crystal surface of the said tabular grains and in that an amount of 50 to 100 mole % of the total amount of iodide ions is located at the surface of said tabular grains.

Iodide ions are therefore provided by using aqueous solutions of inorganic salts thereof as e.g. potassium iodide, sodium iodide or ammonium iodide as described in RD No. 39433, published January 1997, but as an alternative iodide ions provided by organic compounds releasing iodide ions are very useful as has e.g. been described in EP-A's 0 561 415, 0 563 701, 0 563 708, 0 649 052 and 0 651 284, in WO 96/13759 and in RD No. 39423, published January 1997. Especially in order to obtain a more homogeneous iodide distribution in the crystal lattice of individual crystals and over the whole crystal population iodide ions provided by organic agents releasing iodide ions are preferred, such as mono iodide acetic acid, mono iodide propionic acid, mono iodide ethanol and even hydrogels containing iodide ions, capable to generate iodide ions. Generation of iodide ions is triggered in the preparation method by changing the pH value in the reaction vessel during or, preferably, after addition of the said organic agent releasing iodide ions, wherein this pH change is performed therein in such a way as required by the method of the present invention. Opposite to the addition of potassium iodide as a source of iodide ions the said organic compounds releasing iodide ions are leading to a more homogeneous iodide ion distribution over the different tabular crystals, thus avoiding undefined heterogeneities and irreproducibilities. Another method of triggering generation of iodide ions is performed by addition of sulphite ions to the reaction vessel.

In another embodiment according to the method of the present invention said tabular grains are enriched in iodide by adding silver iodide microcrystals having an average crystal size of up to at most 0.05 $\mu$m. Generation of iodide ions is triggered therein by differences in solubility between large {111} tabular silver chlor(oiod)ide or silver chlorobrom(oiodid)ide crystals and such fine silver iodide microcrystals, a phenomenon that is well-known as "Ostwald ripening".

Combinations of inorganic and organic agents providing iodide ions may also be useful. The presence of iodide ions thereby stabilizes the (111)-crystal faces: it has e.g. been established that the concentration of crystal habit modifier present at the surface of the tabular grains rich in silver chloride can be decreased to a considerable extent when iodide ions are present, as iodide ions, provided to the surface of the said grains, lead to preservation of a stable crystal habit. Iodide ions can thus replace conventional crystal habit modifiers such as adenine, etc. Other compounds as spectral sensitizers or stabilizers can also be used as suitable compounds replacing said crystal habit modifiers due to their crystal habit stabilizing action. The presence of iodide ions at the crystal surface of tabular crystals rich in chloride is moreover in favour of adsorption of spectral sensitizers at that large crystal surface due to improved J-aggregation. As a consequence an improved absorption of light in the wavelength range for which the crystal has been made sensitive is observed.

Although the presence of iodide is preferred with respect to intrinsic and to spectral sensitivity it is recommended to limit average iodide concentrations to up to 3 mole % and even more preferably to limit them from 0.1 mole % to 1.3 mole %, based on the total silver amount as higher concentrations retard development and lead to unsatisfactory sensitivities. Moreover the velocity of fixation can be disturbed in that case and as a consequence residual coloration may be unavoidable. In EP-A 0 678 772 e.g. an excessive amount of iodide has been provided by conversion at the end of precipitation and thus at the end of the last growth step in order to have a total concentration of iodide of about 1.3 mole % in the silver chloroiodide emulsion thus obtained.

Bromide ion concentrations of up to 25 mole % based on the total silver amounts are contemplated, but in order to avoid a strong inhibition of the processing, the tabular silver chlorobromoiodide emulsion crystals used according to the method of the present invention preferably have an amount of silver bromide of not more than 10 mole %, based on silver.

In order to reduce the amount of replenisher in the processing, it is even more preferable to reduce the amount of bromide ions up to less then 5 mole %. Bromide ions may be provided from at least one inorganic and/or organic agent providing bromide ions.

Emulsions comprising silver chlorobromoiodide or chloroiodide {111} tabular crystals may be built up so that an amount of 20 to 100 mole %, and even an amount of 50 to 100 mole % of the total amount of iodide ions is located at the surface of the said emulsion crystals as e.g. in EP-A 0 678 772 cited hereinbefore. Iodide ions can be present in one or more shell regions, in form of zones wherein iodide ions are concentrated locally.

According to the method of the present invention distributions of {111} silver halide crystals rich in chloride over the whole population of a silver halide emulsion are made homogeneous up to a variation coefficient on sphere equivalent diameter (SED) of all grains being lower than 0.30. It is however clear that besides setting pH to a value of lower than 6.0, and more preferably to a value of not more than 4.0, for at least 30 seconds after the nucleation step, followed by resetting pH to the initial pH between 6.0 and 9.0 careful controll of pAg, temperature, dilution of the reaction vessel (which can be avoided e.g. by ultrafiltration), presence of grain growth restrainers or grain growth accelerators, addition rate of added aqueous soluble silver salt and halide solutions during different precipitation steps (especially during the nucleation step during which e.g. less than 10% of the total amount of silver salt available is consumed and further during the at least one growth step during which at least 90% of the said silver salt is consumed), way of mixing and mixing or stirring rate in the reaction vessel during the different precipitation steps further determines the real variation coefficient on EVD obtained. If {111} tabular grains having such a homogeneous grain distribution are prepared according to the method of the present invention and if they are coated in hydrophilic light-sensitive layers a silver halide photographic material a decreased exposure latitude can be expected. This problem can however easily be solved by making mixtures of different homogeneous emulsions having very low variation coefficients, prepared according to the method of the present invention. Application of mixtures of more homogeneous emulsion grains may lead to even more advantageous sensitometric characteristics as e.g. increased contrast and/or image quality (e.g. granularity and/or sharpness). Moreover a more reproducible manufacturing of such materials can be expected, in favour of consistency.

For radiographic applications photographic advantages of {111} tabular grains compared to normal globular grains are a high covering power at high forehardening levels, a high developability and higher sharpness thanks to a reduced degree of cross-over, especially in double side coated spectrally sensitized materials.

In spite of the said important advantages, tabular grains, those rich in silver chloride (as well as those rich in silver bromide), especially in early days of their development, had two important disadvantages which should be encountered being their high susceptibility to mechanical stress and their an unacceptable reddish-brown color of developed silver if compared with the desired cold-black color shown by more globular grains. Tabular grains rich in silver chloride even show a worse image tone than those rich in bromide having comparable dimensions (thickness and aspect ratio) after processing in classical processing solutions used in the processing of classical radiological materials. Methods to prepare thicker tabular grains in order to get a more suitable image tone have already been described in U.S. Pat. Nos. 4,801,522; 5,028,521 and 5,013,641 and EP-A 0 569 075 (particularly for silver bromide and silver bromoiodide crystals).

According to the method of the present invention however thicker tabular grains obtained by decreasing pH to lower value after nucleation, followed by resetting said pH to a value between 6.0 and 9.0, don't show those disadvantages. The presence of iodide ions at the crystal surface by introduction of a variable iodide profile, in that the grains have been enriched in iodide at the crystal surface, wherein said profile is characterized by the presence of iodide ions in the crystal volume in lower amounts than at the crystal surface of the said tabular grains and in that an amount of 50 to 100 mole % of the total amount of iodide ions is located at the surface of said tabular grains, partially converting the said surface, moreover leads to tabular grains which are less susceptible to pressure phenomena.

Reddish-brown color of developed thinner {111} tabular grains prepared according to the method of the present invention can further be corrected by increasing the optical density in the red region of the visible spectrum by adding suitable dyes to the undercoat layer, to the emulsion layer and/or to the protective layer. This non-image wise color correction method has been disclosed in references as e.g. JP-A's 03 100 645; 01 029 838; 01 312 536; 03 103 846; 03 094 249; 03 255 435; 61 285 445; and the issued EP-A 271 309 and U.S. Pat. No. 4,861,702. This however inevitably leads to an undesirable higher gross-fog of the photographic material. A more suitable way consists in an image-wise color correction. This can be made by making use of color-forming developers, which are colored blue in their oxidized form. Examples thereof are summarized in JP-A's 03 153 234; 03 154 043 and 03 154 046. In JP-A's 03 156 447 and 03 157 645 the adsorption of a blue colored dye as a function of exposure has further been disclosed.

It may be further useful to coat multilayer silver halide photographic negative image type materials comprising on at least one side of a support a multilayer composition of at least two layers of negative image type silver halide emulsions adjacent to each other, wherein the emulsion layer closest to the said support comprises {111} silver chloroiodide or silver chlorobromoiodide tabular emulsion crystals prepared by the method of the present invention and wherein the adjacent layer(s) farther from the said support comprise (s) essentially cubic emulsion crystals selected from the group consisting of silver chloride, silver chlorobromide and silver bromide. In the specific case described in EP-A 0 770 909, the halide composition of the said cubic emulsion crystals or of the said tabular emulsion crystals or both includes chloride. Coating of two or more layers however is not advantageous, neither economically, nor ecologically as coating of higher amounts of silver halide can be expected.

Still another way to promote a suitable cold-blue image tone has been described in EP-A 0 792 526 and in EP-Application No. 96203262, filed Nov. 21, 1996 wherein a blue colored pigment in dispersed form having a solubility of less than 10 mg/l at 25° C. has been added to an interlayer between a light-sensitive emulsion layer and a non-light-sensitive protective antistress layer or wherein blue colored polymeric matting particles have been added to light-sensitive silver halide layers respectively.

Tabular {111} grain emulsion grains prepared according to the method of the present invention may further be doped with whatever a dope as e.g. with group VIII metal ions like $Rh^{3+}$, $Ir^{4+}$, $Ru^{2+}$ and $Co^{2+}$ or with $Cd^{2+}$, $Zn^{2+}$ or $Pb^{2+}$ or even with a mixture thereof. Other suitable dopants used during precipitation or chemical ripening of said emulsion crystals may be e.g. Fe, Ni, Ru, Rh, Pd, Os, Pt, Hg, Tl and Au. Most preferred are ruthenium, rhodium and iridium. Combinations of one or more dopant(s) may be added, in the same or different preparation steps of the said {111} tabular silver chloroiodide or silver chlorobromoiodide crystals. Just as halide ions the said dopants can be divided homogeneously or heterogeneously over the total crystal volume. So in the core or in the shell or even at the crystal surface, as is e.g. the case when conversion techniques are applied, the said halide ions and/or the said dopants may be concentrated.

It has further been established that addition of small amounts of e.g. iridium compounds during and/or at the end of the precipitation step and/or in the chemical ripening step is highly preferred and leads to a positive effect on processing latitude, in that less differences in sensitivity and gradation are observed after fluctuations in developing time within a range of 5 seconds and in processing temperature within a range of 10° C., if compared with iridium doped silver bromide and silver bromoiodide crystals. Preferred amounts of a preferred compound as e.g. potassium hexachloroiridate(III), added during chemical ripening, are from 0.5 to 20 μmole per mole of silver and more preferred from 1 to 5 μmole per mole as has been described in EP-A 0 794 456 and U.S. Pat. No. 5,712,081.

An important factor influencing growth of silver nuclei in the preparation method of the {111} tabular silver chloroiodide or silver chlorobromoiodide grains, is the choice of and the amount of protective colloid present in the reaction vessel or added simultaneously with one of the solutions added thereto during nucleation and further, eventually, after nucleation, during physical ripening before and/or during growth of the nuclei formed. The most well-known and practically used hydrophilic colloidal binder is gelatin. Gelatin as a dispersing medium may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerizable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29(1), 17, 22(1966), ibid., Vol. 30(1), 10, 19(1967), ibid., Vol. 30(2), 17(1967), and ibid., Vol. 33(3), 24(1967) may be used as a dispersion medium. Also the crystal habit restraining agent described in EP-A 0 534 395 may be used. Part of gelatin may further be replaced with a synthetic or natural high-molecular material.

In the nucleation step, gelatin having a lower methionine content is often used in the preparation of tabular {111} silver halide crystals rich in chloride. The most preferred gelatin used has a methionine content of from 1 to 60 μmole/g depending on each specific case. More preferably gelatin having a methionine content of from 1 to 50 μmole/g, and still more preferably amounts from 1 to 30 μmole/g (4400 p.p.m.) may be preferably used: according to U.S. Pat. No. 4,713,323, oxidized gelatin is defined as a gelatin having a methionine content of less than 30 μmole/g.

Conventional lime-treated or acid treated gelatin can also be used. The preparation of such gelatin types has been described in e.g. "The Science and Technology of Gelatin", edited by A. G. Ward and A. Courts, Academic Press 1977, page 295 and next pages. The gelatin can also be enzyme-treated as described in Bull. Soc. Sci. Phot. Japan, N° 16, page 30 (1966). A preparation method of tabular grain emulsions wherein in the grain growth process use is made of gelatin derivatives with chemically modified $NH_2$-groups and wherein said gelatin has a specific methionine content has been described in e.g. EP-A 0 697 618. Oxidation of methionine reduces the complexing ablity of gelatin. A preparation method of gelatin having a controlled methionine content is disclosed in U.S. Pat. No. 5,412,075.

Another factor which may be important in the nucleation and/or grain growth mechanism of {111} tabular grains rich in chloride is the calcium content of gelatin used as a colloidal binder. In most commercial high-quality inert gelatins the calcium content is about 0.4%, which corresponds with about 100 mmole/kg, measured at the end of the preparation process of inert gelatin. Complex-bound calcium ions strongly decrease the electric potential carried by gelatin. Substantially "calcium free gelatin" is thus defined as gelatin with a calcium content at a level below 40 ppm which corresponds with the analytical detection limit. Prevention of roller marks thanks to the use of gelatin containing less calcium has e.g. been described in JP-A 01-179141, whereas adhesion properties and curl of materials comprising a defined calcium ion content have been described in U.S. Pat. No. 5,496,691. Influences on surface glare have been described in JP-B 91-080292. Drying properties of materials run in rapid processing applications of a material having a well-defined amount of calcium in its gelatinous binder have been described in JP-A's 01-073337, 03-253839 and 07-140576; and in U.S. Pat. Nos. 5,318,881 and 5,302,505. In EP-A 0 809 135 a process has been disclosed for the preparation of a photographic silver halide emulsion comprising one or more precipitation steps in a reaction vessel, said emulsion comprising {111} tabular grains, containing at least 50 mole % of chloride, wherein at least 50% of the total projected area of all grains is provided by said tabular grains, and wherein said tabular grains exhibit an average aspect ratio of at least 5, an average thickness of at most 0.5 $\mu$m, and an average diameter of at least 0.6 $\mu$m, characterized in that during said one or more precipitation steps a gelatin binder is present in said reaction vessel which is substantially free of calcium ions. It was very surprising to find therein that the mere use of $Ca^{++}$ free gelatin as a binder during the preparation of tabular grains rich in chloride resulted on such a pronounced effect on the obtained crystallographic and sensitometric properties. More tabular grains are formed that are smaller on the average but nevertheless show an excellent sensitivity.

An interesting substitute for gelatin may be silica as has been described in the published EP-A's 0 392 092, 0 517 961, 0 528 476 and 0 649 051 and 0 704 749. As has been set forth in EP-A 0 528 476 a method of preparing a silver halide light-sensitive photographic material incorporating layers of silver halide precipitated in colloidal silica serving as a protective colloid is given.

For the precipitation processes wherein suitable silica sols are required as colloidal binder commercially available such as the "Syton" silica sols (a trademarked product of Monsanto Inorganic Chemicals Div.), the "Ludex" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 $\mu$m. The smaller particles in the range from 3 nm to 0.3 $\mu$m, and still more preferable from 3 nm up to 7 nm are preferred as the covering degree that can be achieved will be higher and as the protective action of the colloidal silica will be more effective.

In a preferred mode the precipitation reaction of the {111} tabular silver chloroiodide or silver chlorobromoiodide emulsion crystals proceeds in a dispersing medium wherein the ratio by weight of gelatin to an equivalent amount of silver nitrate is up to 0.35, unless colloidal silica is used in order to replace gelatin partially or totally. It is clear that this condition will be not fullfilled either when use is made in the reaction vessel, in part or integrally of a non-aqueous medium, of a non-aqueous solvent instead of water, as has been disclosed e.g. in U.S. Pat. Nos. 5,478,718 and 5,541,051.

At the end of the precipitation, following all possible physical ripening steps, the emulsion mixture is normally cooled to about 40° C., before or after adding a flocculate being a polymeric compound as e.g. polystyrene sulphonic acid, providing as a anionic polymer a behaviour depending on pH. Under carefully controlled conditions of addition and stirring rate the pH of the said dispersing medium is adjusted with an acid to a value in order to get a qualitatively good flocculate. Said flocculate may become decanted and washed with demineralized water in order to remove the soluble salts and the development inhibiting crystal habit modifier e.g. adenine to an allowable residual amount (preferably at most 0.3 mg/g of gelatin) or applying an ultrafiltration washing procedure as disclosed e.g. in Research Disclosure, Vol. 102, Oct. 1972, Item 10208, Research Disclosure Vol. 131, March, Item 13122 and Mignot U.S. Pat. No. 4,334,012. Said ultrafiltration technique may be applied on-line during the whole precipitation, in order to reduce the increasing amount of water, thus avoiding dilution of the reaction vessel and increasing amounts of soluble salts like the mainly occurring potassium nitrate.

Examples thereof have been described e.g. in EP-A 0 577 886. When the emulsion after precipitation is washed by diafiltration by means of a semipermeable membrane, a technique also called ultrafiltration, it is not necessary to use polymeric flocculating agents that may disturb the coating composition stability before, during or after the coating procedure. Such procedures are disclosed e.g. in Research Disclosure Vol. 102, Oct. 1972, Item 10208, Research Disclosure Vol. 131, March, Item 13122 and U.S. Pat. No. 4,334,012. Preferably, at the start of the ultrafiltration, there is no pH or pAg adjustment as pH and pAg are the same as at the end of the preceding precipitation without any adjustment stage. Moreover ultrafiltration may be proceeded in order to get the desired pH and pAg values, required when performing further treatment steps as e.g. addition to coating solutions. Any washing step may further be performed by means of halide containing water, preferably water containing chloride ions.

Redispersion may further be performed by addition of extra hydrophilic colloid. As a consequence values of gesi and/or sisi may be enhanced up to values desired in order to prepare stable coating solutions as will be clear from the description following hereinafter. It is clear however that any useful protective colloid cited hereinbefore as an alternative of gelatin or gelatin in modified form may be used.

Useful spectral sensitizers benzimidazolo-carbocyanines or benzoxazolo-carbocyanines or asymmetrical benzimidazolo-benzoixazolocarbocyanines. More preferred are the green light absorbing spectral sensitisers as anhydro-5,5'-dichloro-3,3'-bis(n-sulphobutyl)-9-ethyloxacarbocyanine hydroxide or anhydro-5,5'-dichloro-3,3'-bis(n-sulphopropyl)-9-ethyl-oxacarbocyanine hydroxide.

A suitable mixture of spectral sensitizers that is applied is the anhydro-5,5'-dichloro-3,3'-bis(n-sulphobutyl)-9-ethyl oxacarbocyanine or anhydro-5,5'-dichloro-3,3'-bis(n-sulpho-propyl)-9-ethyloxacarbocyanine compound spectrally sensitizing {111} tabular grains prepared according to the method of the present invention apart or together with the anhydro-5,5'-dicyano-1,1'-diethyl-3,3'-di(2-acetoxyethyl)-ethyl-imidacarbocyanine compound.

Specific combinations of imidacarbocyanines and oxacarbocyanines as spectral sensitizers added to emulsions prior to chemical sensitization have been described e.g. in EP-A 0 608 955. Unsymmetrically chain substituted oxacarbocyanine dyes and/or imidacarbocyanine dyes to improve dye stain and spectral sensitivity in the green short wavelength region have been given in JP-A 03-048235. Supersensitization with a symmetrical oxacarbocyanine dye in combination with a carbocyanine dye of e.g. the oxazole-imidazole type has been disclosed in U.S. Pat. Nos. 4,594,317 and 4,659,654. Specifically spectral sensitization of tabular grains with N-fluoro-alkyl substituted imidacarbocyanine dyes has been described in U.S. Pat. No. 4,675,279.

In classical emulsion preparation spectral sensitization traditionally follows the completion of chemical sensitization. However in connection with tabular grains, it is highly contemplated that spectral sensitization occurs simultaneously with or even precedes completely the chemical sensitization step.

It can be advantageous to add an amount of a spectral sensitizing dye to the emulsion crystals just before cooling of the dispersion at the end of the growth stage, but in principle the addition of said dye may be performed at any stage of the precipitation, during or after redispersing or before, during or after chemical ripening. The addition can further be performed in one or more portions. So in U.S. Pat. No. 5,286,621 it has been shown that spectral sensitizer is added in amounts ranging from $10^{-5}$ to $5\times10^{-3}$ moles per mole of silver halide as a whole after completion of the precipitation or in several fractions during and after precipitation.

Besides dyes absorbing blue and/or green light, dyes absorbing radiation in the red or infrared wavelength region of the wavelength spectrum may be added, said dyes being selected from the group consisting of di-, tri-, tetra-, penta- and heptamethine cyanines and merocyanines, rhodacyanines and polynuclear merocyanines as e.g. the dyes absorbing in the infrared region, are described e.g. in JP-A 02 071 257 and in Research Disclosure 00 289 052, May 1988, p. 301–303 and the red-light absorbing heptamethines as in EP-A 0 757 285, and rhodacyanines as in EP-A 0 473 209.

Dyes absorbing in the blue wavelength region of the visible spectrum for use as spectral sensitizers for tabular silver halide grains rich in chloride have been described in JP-A 01-196031 and in U.S. Pat. Nos. 4,494,212; 4,952,491 and 5,376,523. As is well-known and as described in U.S. Pat. Nos. 5,108,887 and 5,376,523 and in EP-A's 0 622 665 and 0 712 034, zeromethine dyes are very useful in the said wavelength region.

As already set forth combinations of differing spectral sensitizers may be used as well as mixtures of emulsions being the same or different, wherein each part may be spectrally sensitized with another spectral sensitizer or with another combination of spectral sensitizers. Spectral sensitizers having asymmetrical heterocycles may be useful with respect to improvements in residual coloration after processing.

Other dyes, which do not have any spectral sensitization activity, or certain other compounds, which do not substantially absorb visible radiation, may have a supersensitization effect when they are incorporated together with said spectral sensitizing agents into the emulsion. Suitable supersensitizers are e.g. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

Spectral sensitizers may be added partially before, partially after or integrally after chemical sensitization with a total amount needed to reach the optimal coverage degree which especially as a consequence of the presence of the large specific surface of {111} tabular grains may differ from amounts added to cubic grains with a factor of about 2 or 3.

The said spectral sensitizers are chosen as a function of the radiation source used e.g. as a function of the light emitted by luminescent phosphors coated in phosphor layers of intensifying screens brought into contact with single-side or double-side coated film materials during X-ray exposure, wherein emulsions comprising silver chlorobromoiodide or silver chloroiodide tabular grains with at least 75 mole % of chloride and from 0.1 up to 3 mole % of iodide, based on silver, further having {111} crystal faces, an average aspect ratio of at least 2:1, with at least 50% of the total projected area of all grains being provided by said tabular grains and with a variation coefficient on sphere equivalent diameter (SED) of all grains being lower than 0.30, prepared according to the method of the present invention are coated.

Silver halide emulsion grains after precipitation and redispersion are called "primitive" or "unripened" as long as no chemical sensitizer(s) is(are) added. It is a common method to add chemical sensitizers after redispersion and in the case of tabular grains during and/or after spectral sensitization as already suggested hereinbefore. Before starting chemical sensitization the surface of the silver halide grains rich in chloride may be treated with slightly oxidizing compounds as e.g. toluene thiosulphonic acid and/or corresponding salts thereof in order to reduce small silver specks to grow to fog centers in an uncontrolled manner.

To silver halide grains rich in chloride chemically sensitizing compounds can be added as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhaloge-niden" edited by H. Frieser and published by Akademische Verlagsgesellschaft (1968).

As described in said literature chemical sensitization can be carried out by effecting the ripening in the presence of small amounts of compounds containing sulphur e.g. thiosulphate, thiocyanate, thioureas; selenium e.g. selenosulphate, selenocyanate, selenoureas; tellurium e.g. tellurosulphate, tellurocyanate, telluroureas; sulphites, mercapto compounds, rhodamines etc. The emulsions can be sensitized also by means of gold-sulphur ripeners, gold-selenium ripeners, gold-sulphur-selenium ripeners, or by means of reductors e.g. tin compounds as described in GB-A 789,823, amines, hydrazine derivatives, formamidine-sulphinic acids, and silane compounds although care should be taken in order to prevent the emulsion from fog formation in an uncontrollable way. As specific examples of the unstable selenium sensitizers, there are isoselenocyanates (e.g., aliphatic isoselencyanates such as allylisoselenosyanate), selenoureas, selenoketones, selenoamides, selenocarboxylic acids (e.g. 2-selenopropionic acid, and 2-selenobutyric acid) selenoesters, diacylselenides (e.g. bis(3-chloro-2,6-dimethoxybenzoyl)selenide), selenophosphates, phosphineselenides, preferably triphenylphosphorselenide and colloidal elemental selenium.

Preferred examples of unstable type selenium compounds shown above are however not limited thereto in any way. For the technical experts in the field of the art, provided that unstable type selenium compounds are sensitizers for silver halide emulsions rich in silver chloride, the structure of the compounds is not so important if selenium is unstable and it is generally understood that the organic moiety of a selenium sensitizer molecule has no role except that it carries selenium and makes the selenium exist in a silver halide emulsion in an unstable form. Preferred chemical sensitizers however are those generating silver selenide in an emulsion comprising the {111} tabular grains prepared according to the present invention at a temperature of from 45° C. up to 70° C. and at a potential difference between a silver electrode and a saturated silver/silver chloride electrode of from 100 up to 200 mV only as set forth in EP-Application No. 97200590, filed Mar. 1, 1997.

As has already been suggested hereinbefore the use of reducing agents in the chemical ripening of silver halide emulsion crystals rich in chloride is not preferred, but not excluded either as depending upon the circumstances it may be recommended to use small amounts in order to counterbalance the restraining actions from spectral sensitisers, fog-restrainers or stabilisers as e.g. substituted heterocyclic mercaptocompounds described in U.S. Pat. No. 5,242,791. Silver solvents may have a regulating role therein as e.g. thiocyanate ions.

Patent literature with respect to the use of selenium sensitizers for chemical ripening of silver halide grains rich in silver chloride, can be found in EP-A's 0 443 453, 0 454 278; 0 458 278; 0 513 748; 0 590 593; 0 661 589 and 0 718 674 and in U.S. Pat. Nos. 4,810,626; 5,306,613 and 5,348,850, wherein said selenium sensitizers are normally used together with other sensitizers as at least gold and optionally sulphur. Especially useful labile compounds providing sulphur are e.g. tetramethyl-thiodithioacetic acid diamide and dimethylamino-dithiomercaptane.

As already set forth additional gelatin or another hydrophilic colloid, suitable as a binder material can be added at a later stage of the emulsion preparation e.g. after washing, to establish optimal coating conditions and/or to establish the required thickness of the coated emulsion layer. Preferably a gelatin to silver halide ratio, silver halide being expressed as the equivalent amount of silver nitrate, ranging from 0.3 to 1.0 is then obtained. Another binder may also be added instead of or in addition to gelatin. Useful vehicles, vehicle extenders, vehicle-like addenda and vehicle related addenda have been described e.g. in Research Disclosure N° 38957 (1996), Chapter II.

Prior to coating any thickening agent may be used in order to regulate the viscosity of the coating solution, provided that they do not particularly affect the photographic characteristics of the silver halide light-sensitive photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica.

Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica. In order to coat hydrophilic colloidal layer compositions on a support by slide-hopper or curtain-coating techniques, wherein said compositions have gelatin in low amounts in order to provide a ratio by weight of gelatin to silver halide expressed as an equivalent amount of silver nitrate in the range from 0.05 to 0.4, thickening agents composed of synthetic clay and anionic macromolecular polyelectrolytes wherein said synthetic clay is present in an amount of at least 85% by weight versus the total amount of thickening agents are recommended as has been disclosed in EP-A 0 813 105.

With respect to the ability of coating of extremely thin hydrophilic layers a light-sensitive silver halide photographic material is disclosed in EP-Application No. 96202601, filed Sep. 18, 1996, wherein said material comprises a support and one or more hydrophilic colloidal silver halide emulsion layers having silver halide crystals with colloidal silica as a protective colloid the said layer(s) having a gesi, defined as ratio by weight of gelatin to silver, in the range from 0 to less than 0.05 and a sisi, defined as ratio by weight of silica to silver, in the range from 0.01 to less than 0.10, wherein said weight of silver in the calculation of gesi and sisi is expressed as an equivalent amount of silver nitrate.

Photographic material having thin emulsion layers e.g. layers with a layer thickness of less than 5 $\mu$m, containing less than 5 g of gelatin, preferably about 3 and more preferably about 2 g/m$^2$ offer the advantage that besides rapid processing applicability and the rapid drying of the wet processed material an improvement in sharpness is observed. Since the drying characteristics in the processor are mainly determined by the water absorption of the hydrophilic layers of the photographic material, and since the water absorption is directly proportional to the gelatin content of the layers and inversely proportional to the amount of hardener, added to the layer, its composition is optimised with a low gelatin content and a high hardening degree in order to allow hardener free processing within a total processing time cycle from 30 to at most 50 seconds dry-to-dry. In a preferred embodiment, a total amount of gelatin of less than 3 g/m$^2$ per side is, if possible, present for the desired application.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

Hardeners may be added to the antistress layer, covering one or more light-sensitive silver halide emulsion layers rich in chloride before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl- 2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxydioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination.

The binders can also be hardened with fast-reacting hardeners such as carbamoylpyridinium salts. Formaldehyde and phloroglucinol can e.g. be added respectively to the protective layer(s) and to the emulsion layer(s). Other preferred hardening agents may specifically be bis-vinylsulphonyl-methyl-ether (BVSME) or ethylene-bis-vinylsulphone.

Materials used in image-forming processes commonly have a hardening degree corresponding with a water absorption of the unexposed material of less than 4 $g/m^2/g$ gelatin, and more preferably of less than 3 $g/m^2/g$ gelatin after immersion in demineralized water at 25° C. during 3 minutes. Another method to express the same may consist in determination of the swelling degree of the layers of the material: said swelling degree is preferably not exceeding 200% and even more preferably not more than 150% as can be measured from thickness ratios of the layers of the material before and after immersion in demineralized water as described hereinbefore.

A lot of other ingredients are further required in order get suitable sensitometric properties, as e.g. sensitivity (also called speed), gradation (also called contrast and specified in the the toe, the linear part and/or the shoulder of the characteristic curve), fog and maximum density in preferred rapid processing conditions that are expected to be particularly advantageous for emulsions rich in silver chloride having gelatin, derivatives and/or substitutes thereof as e.g. colloidal silica etc., discussed hereinbefore. Moreover it is desirable to get practically unchanged characterisitics during production and after storage or preservation of the materials, even under severe circumstances with respect to heat and humidity.

Therefore compounds preventing the formation of fog or stabilizing the photographic characteristics during the production or storage of the photographic elements or during the photographic treatment thereof are required and are in most cases already present during emulsion precipitation and/or (spectral and/or chemical) sensitization. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-A 75-39537, and GB-A 1,500,278, and 7-hydroxy-s-triazolo-[1,5-a]-pyrimidines as in U.S. Pat. No. 4,727,017, and other compounds such as benzenethiosulphonic acid, benzenethiosulphinic acid and benzenethiosulphonic acid amide. Other compounds that can be used as fog-inhibiting compounds have been described in Research Disclosure N° 17643 (1978), Chapter VI; in RD N° 36544 (1994), Chapter VII and in RD N° 38957, Chapter VII, published September 1996.

The photographic element may further comprise various kinds of coating physical property modifying addenda as described in RD N° 36544 (1994), Chapter IX and RD N° 38957 (1996), Chapter IX, wherein coating aids, plasticizers and lubricants, antistats and matting agents have been described. Development acceleration can be accomplished by incorporating in emulsion layer(s) or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element may further comprise various other additives such as e.g. compounds improving the dimensional stability of the photographic element, ultraviolet absorbers and spacing agents.

Suitable additives for improving the dimensional stability of the photographic element are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. No. 3,314,794 and in U.S. Pat. No. 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD N° 38957, Chapter VI, wherein also suitable optical brighteners are mentioned.

Spacing agents may be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

In X-ray photography a material with a single or a duplitized emulsion layer coated on one (single-side coated) or both sides (double-side coated) of the support preferably contains at least one silver chloroiodide or silver chlorobromoiodide emulsion prepared according to the method of the present invention disclosed hereinbefore. A mixture of two or more emulsions from crystals rich in chloride having the same or different crystal sizes, the same or a different crystal habit, a different or the same chemical ripening treatment and/or a different or the same coverage degree with one or more spectral sensitisers being different from each other or the same, as those described hereinbefore may be added to at least one light-sensitive emulsion layer. Single-side coated materials have e.g. been described in U.S. Pat. No. 5,449,599, in EP-A's 0 610 608 and 0 712 036 and in EP-A 0 794 456 and the corresponding U.S. Pat. No. 5,712,081. Double-side coated materials have e.g. been described in U.S. Pat. No. 5,397,687 and in EP-A's 0 678 772, 0 754 971 and 0 754 972.

Besides the light-sensitive emulsion layer(s) the photographic material may contain several light-insensitive layers at the side of the support carrying said light-sensitive emulsion layer(s), e.g. a protective antistress layer which can be split up into two layers, one of them being an underlying interlayer or an outermost afterlayer coated or sprayed on top of the "basic" protective antistress layer, one or more subbing layers, one or more intermediate layers e.g. filter layers and even an afterlayer containing e.g. hardening agent(s), antistatic agent(s), filter dyes for safety-light purposes, etc.

Protective antistress layers preferably contain coating aids and coating physical property modifying addenda mentioned in RD's Nos. 36544 and 38957, published September 1994 and 1996 respectively, Chapter IX. Antistatic properties are especially preferred in order to prevent blackening after processing in form of sparks etc. due to abrupt decharging of electrostatic charges during production and/or handling before exposure and/or processing. It is highly preferred to add antistatic agents to the protective antistress layer or to an afterlayer coated thereupon as has been described e.g. in EP-A's 0 534 006, 0 644 454 and 0 644 456 and U.S. Pat. Nos. 4,670,374 and 4,670,376. Particularly preferred antistatic agents showing permanent antistatic character, retention i.a. after processing of about the same antistatic properties, are polyethylene-dioxythiophene compounds as described in EP-A's 0 339 340,0 340 512, 0 440 957, 0 554 588 and 0 602 713 and the corresponding U.S. Pat. Nos. 5,312,681 and 5,391,472. Abrasion resistance of these outermost layers may be improved as described in U.S. Pat. Nos. 4,766,059 and 4,820,615. Spraycoating of afterlayers has been disclosed e.g. in U.S. Pat. No. 5,443,640. Non-imagewise blackening may alternatively be due to pressure sensitivity of the silver halide grains rich in chloride. Measures in order to prevent pressure sensitivity may be coating of enhanced amounts of binder as e.g. gelatin. This however is disadvantageous with respect to rapid processing and therefore silver halide crystals rich in chloride prepared in silica may offer an alternative as has been disclosed e.g. in EP-A 0 528 476. Moreover with respect to the binder material in the light-sensitive emulsion layer an improvement of pressure sensitivity can be expected if use is made therein from synthetic clays as has been disclosed in U.S. Pat. No. 5,478,709.

In the presence however of spectral sensitized emulsion crystals in the said light-sensitive layers care should be taken in order to select suitable synthetic clays as disclosed in EP-A 0 757 285.

Intermediate layers eventually containing filter- or antihalation dyes that absorb scattering light and thus promote the image sharpness have been described in e.g. U.S. Pat. Nos. 4,092,168; 4,311,787; 5,344,749; 5,380,634; 5,474,881; 5,478,708; 5,502,205; in EP-A 0 489 973 and 0 586 748 and in EP-A 0 781 816 and 786 497; in DE-A 2,453,217, and in GB-A 7,907,440. Situated in such an intermediate layer between the emulsion layers and the support there will be only a small negligable loss in sensitivity but rapid processing conditions, although said dyes decolorize very rapidly in alkaline solutions, require minimization of the thickness of the whole coated layer, an item which has already been discussed hereinbefore: multilayer arrangements of thin layers clearly result in shorter drying times after washing in the processing cycle. It is further in favour of decolorizing properties to have said suitable dyes in form of finely dispersed form and more preferred in solid particle dispersed form. Evidence therefore is specifically given in EP-A 0 724 191 and in a more general way in EP-A 0 756 201.

In addition thereto it is recommended to prepare aqueous solid dispersions in colloidal silica for any photographically useful compound as has been described e.g. in EP-A 0 569 074. Advantages with respect to thin layer coating and rapid processing ability can be expected, without enhancing pressure sensitivity of more vulnerable layers.

Backing layers applied to a material having at least one emulsion layer at one side of a light-sensitive silver halide material having emulsion crystals rich in chloride used in the image-forming systems essentially contain as ingredients hydrophilic colloids, one or more antihalation dye(s), matting agent(s), surfactant(s), antistatic agent(s), lubricant(s) and hardening agent(s), said ingredients being same as discussed hereinbefore.

Amounts of hydrophilic colloids may be chosen in order to prevent curl of the single side emulsion coated material, such as in U.S. Pat. No. 5,155,013. Also non-swelling hydrophobic polymers can be used in the backing layer as has e.g. been described in U.S. Pat. No. 5,326,686. Further measures to prevent curling have been disclosed e.g. in JP-A's 02-24645; 02-85847 and 02-87138.

The support of the photographic materials comprising silver halide emulsion having crystals rich in chloride, used for X-ray imaging, may be a transparent resin, preferably a blue colored polyester support like polyethylene terephthalate. The thickness of such organic resin film is preferably about 175 $\mu$m. Other hydrophobic resin supports are well known to those skilled in the art and are made e.g. of polystyrene, polyvinyl chloride, polycarbonate and polyethylene naphthalate. The support is further provided with a substrate layer at both sides to have good adhesion properties between the adjacent layers and said support: one or more subbing layers known to those skilled in the art for adhering thereto a hydrophilic colloid layer may be present. Suitable subbing layers for polyethylene terephthalate supports are described e.g. in U.S. Pat. No. 3,397,988, 3,649,336, 4,123,278 and 4,478,907. A preferred layer arrangement wherein a subbing layer composition comprising as a latex copolymer vinylidene chloride, methylacrylate and itaconic acid has been covered with hydrophilic layers being at least one gelatinous dye containing layer comprising one or more dyes, at least one silver halide emulsion layer, at least one protective antistress layer, and optionally an afterlayer has been described in EP-A 0 752 617. In that invention said hydrophilic layers have a swelling ratio of not more than 200% and in said hydrophilic layers are coated simultaneously by the slide-hopper coating or by the slide-hopper curtain coating technique. Further information on suitable supports can be found in RD's Nos. 36544 and 38957, Chapter XV, published September 1994 and 1996 respectively.

In radiography the interior of objects is reproduced by means of penetrating radiation which is high energy radiation belonging to the class of X-rays, $\gamma$-rays and high energy elementary particle radiation, e.g. $\beta$-rays, electron beam or neutron radiation.

For the conversion of penetrating radiation into visible light and/or ultraviolet radiation luminescent substances are used called phosphors.

In a conventional radiographic system an X-ray radiograph is obtained by X-rays transmitted imagewise through an object and converted into light of corresponding intensity in a so-called intensifying screen (X-ray conversion screen)

wherein phosphor particles absorb the transmitted X-rays and convert them into visible light and/or ultraviolet radiation whereto a photographic film is more sensitive than to the direct impact of the X-rays as direct absorption of X-rays is low: for X-rays the mass absorption coefficient is proportional to a power of the atomic number Z as has been teached in the "Encyclopaedic Dictionary of Physics" vol. 7, p. 787, eq. 10, Ed. J.Thewlis, Pergamom Press, Oxford 1957. This strongly disfavours e.g. the use of chloride (Z=17) compared to bromide (Z=35) or iodide (Z=54).

In the case wherein an X-ray radiation source is used, the energy, expressed in kVp, depends on the specific application, as e.g. for the detection of bone, wherein radiation energy of about 80 kVp is used or for soft tissue as in breast imaging wherein no more than 35 kvp is permitted. In order to reduce the effect of scattering radiation a metal filter, usually a lead filter, can be used in combination with the photographic film. In order to permit a comparison: in non-destructive testing applications much higher energies are used of e.g. 235 kVp.

Light emitted imagewise by intensifying screens as in medical diagnosis irradiates a contacting photographic silver halide emulsion layer film which after exposure is developed to form therein a silver image in conformity with the X-ray image.

More specifically for use in common medical radiography the X-ray film comprises a transparent film support double-side coated with a silver halide emulsion layer. During the X-ray irradiation said film is arranged in a cassette between two X-ray conversion screens each of them making contact with their corresponding silver halide emulsion layer.

Single side coated silver halide emulsion films combined in contact with only one screen are often used in autoradiography, in applications where improved image definition is of great importance e.g. in mammography and in particular fields of non-destructive testing (NDT) known as industrial radiography. An autoradiograph is a photographic record formed through the intermediary of penetrating radiation emitted by radioactive material contained in an object, e.g. microtome cut for biochemical research.

Phosphors suitable for use in the conventional radiographic system must have a high prompt emission on X-ray irradiation and low after-glow in favour of image-sharpness.

From the preceding description of said two X-ray recording systems operating with X-ray conversion phosphor screens in the form of a plate or panel it is clear that said plates or panels serve only as intermediate imaging elements and do not form the final record. The final image is made or reproduced on a separate recording medium or display: for X-ray conversion screens single- or double-side coated films are the said final record, whereas for stimulable phosphor plates a single-side coated hard-copy film made by laser imaging may be the said final record. The phosphor plates or sheets of both types can be repeatedly re-used.

Since in the above described X-ray recording systems the X-ray conversion screens are used repeatedly, it is important to provide them with an adequate topcoat for protecting the phosphor containing layer from mechanical and chemical damage. Especially in automated loading for daylight systems as e.g. CURIX CAPACITY, an Agfa-Gevaert trademark product, the reduction of the building up of static electricity as a consequence of friction phenomena during cassette loading and unloading is a function of the contact area and the distance between both the screens and the photographic film. Once the cassette has been loaded the contact between the film and the screens, necessary to obtain good image quality, is intensified by the application of pressure forces at the cassette surface. As a consequence the air included between the surfaces of the screens and the film escapes and a vacuum is created in the cassette. Sticking phenoma, resulting from said contact have to be avoided whereas the breaking of the vacuum has to be promoted after exposure, when the cassette has to be opened and the film has to be transported to the processing unit. Therefore solid particles can be incorporated that protrude from the protective coating as described e.g. in U.S. Pat. No. 4,059,768. However, providing a relief structure that effectively improves manipulation as set forth above is at the cost of image quality. Indeed providing protruding particles requires increased thickness of the protective coating and as a consequence reduced image sharpness due to an increased distance between the radiation emitting phosphor layer and the radiation sensitive coating of the photographic film in contact therewith. Not only the increased thickness itself can give rise to increased unsharpness of the emitted light when the refractive indices of phosphor binder and binder of the protective coating differ but also the presence of the particles themselves having different refractive index compared with that of the binder of the protective coating.

A good compromise in order to provide a luminescent article, e.g. in the form of a plate, panel or web, comprising a phosphor-binder layer and protective coating applied thereto wherein the protective layer has a relief structure for high ease of manipulation, thereby avoiding sticking, friction and electrostatic attraction with maintenance of an excellent image resolution has been described in EP-A 0 510 754. The luminescent article disclosed therein comprises a self-supporting or supported layer of phosphor particles dispersed in a resin binder having applied thereto a protective coating having an embossed structure, more particularly a protective coating having a layer thickness d comprised between 1 and 50 $\mu$m and having an embossed surface roughness $R_z$ so that the ratio between roughness $R_z$ and thickness d is at least 0.35. The embossed protective layer can be provided on the phosphor layer in order to protect it against mechanical and chemical damage by the steps of (1) coating onto said phosphor containing layer a liquid radiation-curable composition having at the coating temperature a viscosity of at least 450 mPa.s, measured with a Hoeppler viscometer, that does not penetrate for a substantial degree into the phosphor containing layer, (2) providing an embossed structure to the coating, and (3) curing said coating by radiation.

From the point of view of the phosphor layer especially an increased thickness itself can give rise to increased unsharpness of the emitted light, this being the more unfavorable if the weight ratio between the amount of phosphor particles and the amount of binder decreases for the same coating amount of said phosphor particles, also called "pigment".

Enhancing the weight ratio amount of pigment to binder to provide sharper images, by decreasing the amount of binder leads to unacceptable manipulation characteristics of the screen due to e.g. insufficient elasticity and brittleness of the coated phosphor layer in the screen.

One way to get thinner coated phosphor layers in favour of sharpness of the image on the film material in contact therewith during exposure and without changing the coated amounts of pigment and of binder makes use of a method of compressing the coated layer as has been described in EP-A 0 393 662. A much better solution in order to provide a phosphor layer having a ratio by volume of pigment to binder to obtain an excellent image resolution with the maintenance of a high ease of manipulation, thereby providing a good elasticity of the screen, good adhesion properties between the support and the phosphor layer and avoiding brittleness of the said phosphor layer has been described in WO94000531, wherein the binding medium of the phosphor layer substantially consists of one or more rubbery and/or elastomeric polymers, in that the ratio by volume of phosphor to binding medium is at least 70:30 and at most 92:8 and in that the packing ratio is less than 67%. By the choice of the type of binder and the high volume ratio of phosphor to binder it is possible to obtain thin phosphor coatings offering not only high resolution but also high sensitivity without the need for increasing the packing density by compressing in order to reduce the voids as defined in EP-A 0 393 662 to a value of not less than 70%. Moreover the phosphor layer retains high protection against mechanical damage and thus high ease of manipulation.

A practically useful binder medium for the phosphor particles has further been disclosed in WO94000530. Therein the binding medium substantially consists of one or more hydrogenated styrene-diene block copolymers, having a saturated rubber block, as rubbery and/or elastomeric polymers. The polymer can be represented by the formula A-B-A (tri-block) or by the formula A-B (di-block), wherein A represents styrene and B represents the hydrogenated diene block e.g. ethylene-butylene or ethylene-propylene.

An improved set of blue-light-emitting screens has e.g. been described in U.S. Pat. No. 5,381,015, wherein an X-ray phosphor screen is provided comprising a support and a layer which comprises a mixture of phosphors essentially consisting of (1) a monoclinic M' structure yttrium tantalate, niobate or tantalate-niobate phosphor, and (2) a rare earth activated alkaline earth fluorohalide phosphor and which may comprise one or more dyes characterized in that the dyes (if any) have a maximum absorption in the wavelength region between 410 and 500 nm and an extinction at said wavelength of maximum absorption of at least twice that at any wavelength below 410 nm and that the amount of said dye(s), the ratio by weight of said phosphors characterizing the phosphor mixture, the phosphor coverage, and the reflectance of the support are selected in such a way that a synergystic effect is obtained between screen speed and sharpness for each of said speed classes.

Specific intensifying screens emitting ultraviolet-blue radiation have further been disclosed in U.S. Pat. Nos. 4,225,653; 4,387,141; 4,710,637; 5,112,700; 5,173,611 and 5,432,351; in EP-A's 0 650 089; 0 658 613; in W093011457 and W095015514. Typical blue-UV emitting phosphors therein are tantalates and hafniates and fluorohalides of barium and strontium. In EP-A 0 820 069, particles of niobium doped, monoclinic M, yttriumtantalate phosphor and particles of an europium doped bariumfluorohalide phosphor are composing the screen.

Specific intensifying screens emitting green light radiation have been disclosed in GB-A 1,489 398; in U.S. Pat. Nos. 4,431,922 and 4,710,637. A typical green emitting phosphor used therein is a gadolinium oxisulphide phosphor.

Screen-film systems wherein blue and/or (ultra)violet radiation emitted by screens is absorbed by suitable films in contact therewith have been described e.g. in EP-A 0 712 034 and in WO93001521. In the said WO a double-side coated element is disclosed containing at least 50% of tabular grains having at least 50 mole % of chloride. Screen-film systems wherein green-light emitting screens are used in contact with green sensitised silver halide films have been described e.g. in EP-A 0 678 772.

Screen/film combinations may be symmetric or asymmetric: this means that screens differing in speed and/or radiation emitted therefrom are differing and/or that there is a difference in speed and/or contrast and/or spectral sensitivity at both sides of the film support.

A symmetric combination for chest imaging is disclosed in EP-A 0 661 592 and in U.S. Pat. No. 5,380,636 wherein speed differences of duplitized layers are at least 0.3 and 0.5 log E, and wherein said layers are spectrally sensitized to the same and to different regions of the electromagnetic spectrum respectively. Asymmetric combinations can be found in U.S. Pat. No. 5,238,795 and in EP-A 0 449 101.

Screen/film combinations with a front screen containing a green emitting phosphor and a back screen comprising a UV-emitting phosphor have been described in EP-A 0 581 065 and in U.S. Pat. No. 4,978,599.

With respect to speed and image quality, high resolution radiographic UV screen-film systems have been described in WO93011457, wherein a relative speed of at least 150 and a CTF (contrast transfer function) of at least 0.30 at 6 line pairs per mm has been measured.

Green light-emitting screen-film systems having cross-over exposure of at most 15% , absorbing X-rays of 80 kVp for at least 25% and offering a CFT of 0.79 and 0.36 at 1 and 3 cycles/mm have been described in U.S. Pat. Nos. 5,460,916 and 5,462,832.

By using duplitized emulsions differing in photographic speed by at least 0.15 log E a reduction in cross-over exposure in double side coated materials can be obtained. Cross-over reductions of less than 5% or at most 15%, depending on the optical density, have been described in U.S. Pat. No. 5,354,648 and USH 0001105 for asymmetric duplitized film materials. Pentamethine oxonol dyes may be helpful in order to reduce cross-over to less than 10% in such film-screen combination as has been described in U.S. Pat. No. 5,252,443. Less than 5% cross-over may be exhibited by a material build-up wherein an average contrast on one side of the film is less than 2.0 and at least 2.5 at the other side as in U.S. Pat. No. 4,994,355 or wherein differences in speed of silver halide layers on opposite sides of the film support are at least 2 as disclosed in U.S. Pat. No. 4,497,750. In order to reach a zero cross-over level UV-absorbing methine compounds may be even admixed in the polyester support or in an intermediate layer between the subbing layer and the emulsion layer closest to the support as has been disclosed in WO's 93005443 and 93005444.

Specific defined radiographic elements and intensifying screens for minimal cross-over in diagnostic imaging of bone and surrounding soft tissue structures have been disclosed in EP-A 0 530 117; in WO95021403, in U.S. Pat. Nos. 5,259,016 and 5,399,470. Improved detective quantum efficiencies can thus be attained as has been described e.g. in U.S. Pat. No. 5,021,327.

As exposure light is diffracted less by silver halide crystals rich in chloride due to less light absorption, as has been illustrated in EP-A 0 580 029, a further advance with respect to image sharpness may be expected. Further as a result of the better solubility of silver halide crystals rich in silver chloride if compared with crystals rich in bromide, it can be expected that with respect to rapid processing ability materials comprising emulsions having silver halide crystals rich in chloride will be more favorable.

An important factor therein however is the coating amount of silver in the silver halide film material. It is clear that e.g. for hardcopy materials used in image-forming methods a coated silver amount expressed as an equivalent amount of silver nitrate, is preferably from 2 to 6 $g/m^2$, and more preferably from 3 to 5 $g/m^2$ as in EP-A 0 794 456 and the corresponding U.S. Pat. No. 5,712,081. These low amounts of silver coated permit remarkably shorter total processing cycles as the well-known 90 seconds cycle: even processing times from 30 up to 50 seconds become available. Moreover a more favorable situation is attained from the viewpoint of ecology as less waste is produced in the processing of films having been coated from low amounts of silver: less developing and fixing solutions are used and lower replenishment amounts will be required.

Opposite thereto in the field of industrial radiography, especially for non-destructive testing applications, wherein more silver is coated (in the range from 5 to 15 g/m$^2$, expressed as an equivalent amount of silver nitrate) it is clear that longer processing times will be required. In U.S. Pat. No. 5,397,687 a total processing time of less than 5 minutes instead of the normal 15 minutes for the total processing cycle with silver halide emulsion crystals rich in silver bromide is attained, however is already a significant improvement.

For processing, preferably an automatically operating apparatus is used provided with a system for automatic replenishment of the processing solutions. The processing dry-to-dry within a short processing time of from 30 to less than 50 seconds of materials coated from low amounts of silver is made possible by the steps of developing said material in a developer (preferably comprising an ascorbic acid or reductic acid) without hardening agent;

fixing said material in a fixer, optionally without (aluminum salt as) hardening agent;

rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may also be present. More details can be found in EP-Application No. 96203728, filed Dec. 30, 1996.

Progress with respect to (ecological) processing methods and (ecological) processing machines have e.g. been described in EP-A's 0 744 652, 0 744 656, 0 744 657, 0 744 658, 0 769 719, 0 774 691, 0 779 546, 0 779 547, 0 779 548, 0 779 549, in EP-Application Nos. 96201753, filed Jun. 24, 1996, 96202032, filed Jul. 17, 1996, 96202164, filed Jul. 31, 1996, 96203298, filed Nov. 25, 1996, 96203183, 96203184 and 96203185, filed all Nov. 14, 1996, 96203727, filed Dec. 30, 1996, 97200840, 97200841 and 97200853, all filed Mar. 21, 1997, 97201052, filed Apr. 10, 1997, 97201117, filed Apr. 15, 1997, 97201814 and 97201815, both filed Jun. 12, 1997, 97202321 and 97202323, both filed Jul. 28, 1997, 97203096, filed Oct. 6, 1997, 97203632, filed Nov. 21, 1997, 98200079, filed Jan. 15, 1998, in WO 97/33196 and in U.S. Pat. No. 5,678,118.

While the invention has been described in detail and with reference to specific embodiments thereof, it will be apparent to one skilled in the art that various changes and modifications can be made therein without departing from the spirit and the scope thereof.

EXAMPLES

Example 1

Emulsion A (comparative example)

($Agcl_{98.9}I_{1.1}$ silver chloroiodide tabular grain emulsion):

The following solutions were prepared:

2.94 l of a dispersion medium (C) containing 0.19 moles of sodium chloride and 75 g of oxidized gelatin for use as a protective colloid, was established at a temperature of 45° C.;

a solution containing 36 ml of a 1% solution of adenine (N);

a 2.94 molar silver nitrate solution (A1);

1 liter of a solution containing 2.92 moles of sodium chloride, 0.015 moles of potassium iodide and 42 ml of a solution (1% by weight) of adenine (B1), 40 ml of a solution containing 17.64 millimoles of potassium iodide (B2).

Before the start of the precipitation solution N was added to solution C. Solution C was then stirred for 15 minutes and set at a pH value of 6.0.

A nucleation step was performed by introducing solution A1 and solution B1 simultaneously in dispersion medium C, at a flow rate of 45 ml/min for both of them during 40 seconds.

During a physical ripening time of 20 minutes, the temperature was increased to 70° C.

Then a growth step was performed during a time of 28 minutes and 50 seconds by introducing a double jet solution A1 at an initial flow rate of 5 ml/min, said flow rate being immediately linearly increased to a flow rate of 13.7 ml/min, together with a solution B1 at a flow rate in order to maintain a constant potential of +115 mV measured by a silver electrode versus a $Ag/AgCl_{sat}$ Ingold reference electrode. Further an addition step was performed wherein solution A1 was introduced in a time interval of 16 minutes at a constant flow rate of 5 ml/min in order to get a potential value of +135 mV. After this step, called "pAg adjustment step" the flow rate of solution A1 was linearly increased over a period of 49 minutes and 33 seconds to 20 ml/min, while the flow rate of solution B1 was increased in order to maintain the constant potential of +135 mV. Another physical ripening step of 6 minutes was performed. A last precipitation step was performed by introducing solution B2 by a single jet at a constant flow rate of 20 ml/min during 2 minutes.

After the precipitation 28 ml of polystyrene sulphonic acid was added to the emulsion which was stirred for 5 minutes. The pH was adjusted to a value of 3.0. The emulsion was desalted by a washing process with 4 l of demineralized water, which was repeated 3 times after decantation of the supernatant liquid.

The thus obtained silver chloroiodide {111} tabular grain emulsions having 1.1 mole % of iodide ions based on silver, comprised a high percentage by number (at least 90%) of tabular grains, having an average aspect ratio of more than 7:1 which was calculated from the corresponding electron microscopic photographs on which an average ECD (equivalent circular diameter) of 1.75 $\mu$m and a mean thickness of 0.13 $\mu$m were measured.

Figure 2:
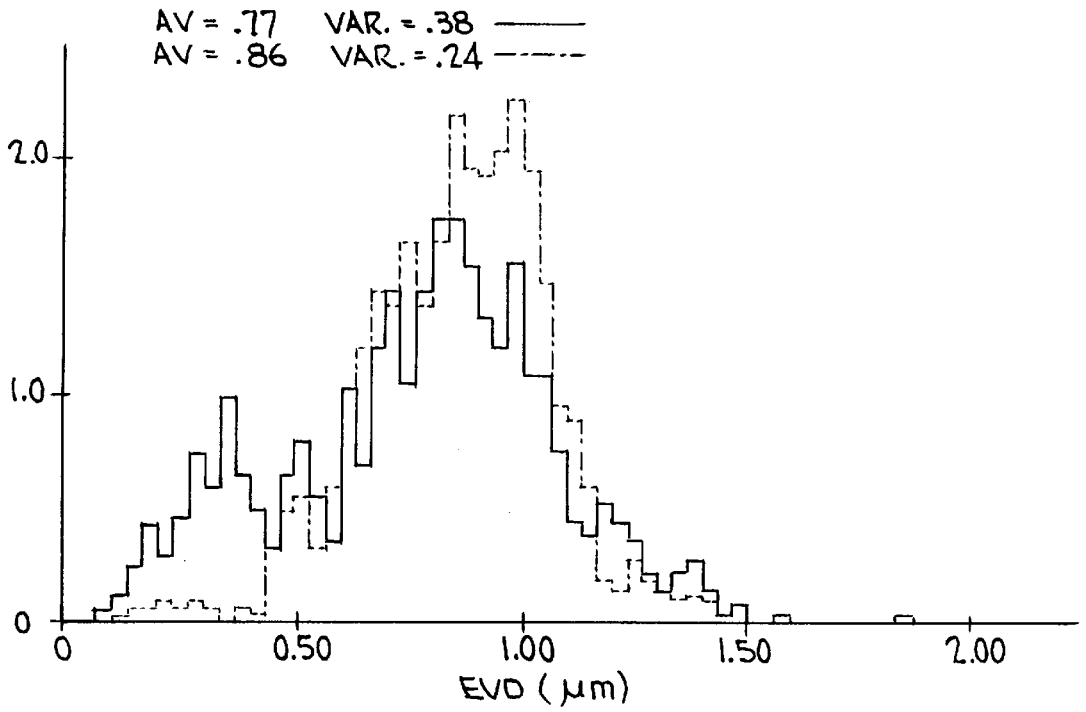

In FIG. 2 the silver chloriodide distribution is given of the emulsion as obtained from reduction of silver halide grains, thus representing the abundance of equivalent volume diameters (EVD) calculated from spheres representing the same volume of the reduced silver halide (tabular or non-tabular) grain. From this EVD distribution a variation coefficient of 0.38 was calculated.

During redispersion of the emulsions an amount of inert gelatin was added in order to adjust the ratio by weight of gelatin to silver halide (expressed as silver nitrate) to a value of 0.4. The emulsion was containing an amount of silver chloroiodide of 215 g per kg, expressed as an equivalent amount of silver nitrate.

Examples B, C and D (inventive examples)

($AgCl_{98.9}I_{1.1}$ silver chloroiodide tabular grain emulsions):

Except for the "pAg adjustment step", cited hereinbefore, Emulsions B, C and D were prepared in the same way as emulsion A. During this particular step the pH was adjusted to a lower value being 4.0: for emulsion B 3.5: for emulsion C 3.0: for emulsion D The pH-value was then re-adjusted to a value of 6.0 after 16 minutes.

In the Table 1 the mean grain thicknesses and the variation coefficients on EVD (ratio of average standard deviation of ECD and mean or average ECD) are also shown.

TABLE 1

| Emulsion | pH during mV-adjustment step | mean thickness (pm) | variation coefficient on EVD |
|---|---|---|---|
| A (comp.) | 6.0 | 0.13 | 0.38 |
| B (inv.) | 4.0 | 0.18 | 0.25 |
| C (inv.) | 3.5 | 0.25 | 0.24 |
| D (inv.) | 3.0 | 0.42 | 0.27 |

It is clear that by introducing this pH-lowering step an opportunity is offered to controll the thickness and homogeneity of the obtained tabular silver chloroiodide grains. The distribution of emulsion C is included in FIG. 2 (see dotted line) in order to illustrate the improvement of the homogeneity of the silver chloroiodide grain distribution: a variation coefficient of 0.24 is calculated now.

The value to which the pH is lowered is clearly determining the average end thickness of the grains: a lower pH leads to an increased average thickness.

Examples E, F and G (inventive examples)

($AgCl_{98.9}I_{1.1}$ silver chloroiodide tabular grain emulsions)

In these emulsions another factor determining the growth of thickness is illustrated. Except for the "pAg adjustment step", Emulsions E, F and G were prepared in the same way as emulsion B (pH=4.0). While in the preparation of emulsion B the pH was lowered to a pH value of 4.0 during the whole time period of 16 minutes, in emulsion E pH lowering was started at the same time but only lasted for 5 minutes. Emulsion F was prepared in the same way as Emulsion E expect for the flow rate of A1 during the 'pAg adjustment step'.

Finally emulsion G was prepared in a similar way as emulsion A where pH was lowered to a value of 4.0 during the last 8 minutes of the physical ripening step.

The results were listed in Table 2 wherein all variations made during emulsion preparation of Emulsions E, F and G are also represented.

TABLE 2

| Emulsion | Time at pH = 4.0 during 'pAg adjustment step' | Flow Rate of A1 during 'pAg adjustment step' | mean thickness (μm) | variation coefficient on EVD |
|---|---|---|---|---|
| A (comp.) | — | 5 ml/min. | 0.13 | 0.38 |
| B (inv.) | 16 min. | 5 ml/min. | 0.18 | 0.25 |
| E (inv.) | 5 min. | 5 ml/min. | 0.16 | 0.26 |
| F (inv.) | 5 min. | 0 ml/min. | 0.16 | 0.26 |
| G (inv.) | — | 5 ml/min. | 0.19 | 0.24 |

From the Table 2 it is clear that not only the degree of lowering the pH is determining the end value of the average thickness of the tabular grains but also the time during which this pH value is held constant at the lower pH value (see comparison between E and B).

Changing this time offers the opportunity of controlling the thickness growth of the tabular silver chloroiodide grains obtained.

Emulsion F illustrates that lowering of pH during physical ripening steps introduced in between the growth steps (flow rate of solutions=0 ml/min.) also leads to controlled thickness growth according to the method of the present invention.

Emulsion G shows the possibility to carry out the pH adjustment during the first physical ripening step before any growth step has been carried out.

We claim:

1. Method of preparing a silver halide emulsion comprising silver chlorobromoiodide or silver chloroiodide tabular grains with at least 75 mole % of chloride and from 0.1 up to 3 mole % of iodide, based on silver, further having {111} crystal faces, an average aspect ratio of at least 2:1, with at least 75% of the total projected area of all grains being provided by said tabular grains and with a variation coefficient on sphere equivalent diameter (SED) of all grains being lower than 0.30, said method comprising the steps of preparing a dispersion medium and a crystal habit growth modifier in a reaction vessel;

precipitating silver chlor(oiod)ide or silver chlorobrom(oiod)ide nuclei in a crystal nucleation step by mixing silver salt and halide salt solutions in the said dispersion medium, growing the said nuclei during one or more growth and/or physical ripening steps;

characterized by maintaining the said dispersion medium at an initial pH value between 6.0 and 9.0 during the said crystal nucleation step;

setting pH to a value of not more than 4.0 for at least 30 seconds, between ending the said nucleation step and ending the said growing step; followed by resetting pH to the said initial pH value.

2. Method according to claim 1, wherein the said tabular grains account for at least 90% of the total projected area of all grains.

3. Method according to claim 1, wherein the said variation coefficient on sphere equivalent diameter (SED) of all grains is from 0.05 to 0.25.

4. Method according to claim 1, wherein said crystal habit growth modifier has a chemical structure according to the formula Ia or Ib, wherein:

(Ia)

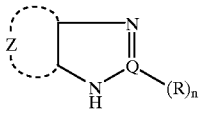

(Ib)

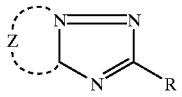

Z represents the atoms necessary to form a fused aromatic carbocyclic or heterocyclic ring which may be substituted with alkyl, alkenyl, aryl, alkoxy, hydroxy, mercapto, carboxy or halogen;

R is hydrogen or a substituent as listed for ring Z;

n is 0 or 1; and

Q represents carbon when n =1, or nitrogen when n=0.

5. Method according to claim 1, wherein said crystal habit growth modifier is adenine.

6. Method according to claim 1, wherein growing the said nuclei is performed by double jet precipitation, wherein iodide salt solutions are optionally present in the said halide salt solutions essentially consisting of chloride salts and optionally of bromide salts characterized by maintaining the said chloride salts in the reaction vessel at a constant concentration of less than 0.15 M.

7. Method according to claim 1, wherein during growing the said nuclei at least one conversion step is performed, wherein converting the said emulsion grains is performed by adding an inorganic iodide salt to the reaction vessel.

8. Method according to claim 1, wherein after growing the said nuclei at least one conversion step is performed, wherein converting the said emulsion grains is performed by adding an inorganic iodide salt to the reaction vessel.

9. Method according to claim 1, wherein during and after growing the said nuclei at least one conversion step is performed, wherein converting the said emulsion grains is performed by adding an inorganic iodide salt to the reaction vessel.

10. Method according to claim 1, wherein during growing the said nuclei at least one conversion step is performed, wherein converting the said emulsion grains is performed by adding an organic iodide releasing compound to the reaction vessel.

11. Method according to claim 1, wherein after growing the said nuclei at least one conversion step is performed, wherein converting the said emulsion grains is performed by adding an organic iodide releasing compound to the reaction vessel.

12. Method according to claim 1, wherein during and after growing the said nuclei at least one conversion step is performed, wherein converting the said emulsion grains is performed by adding an organic iodide releasing compound to the reaction vessel.

13. Method according to claim 1, wherein during growing the said nuclei at least one conversion step is performed, wherein converting the said emulsion grains is performed by adding silver iodide microcrystals having an average crystal size of at most 0.05 $\mu$m.

14. Method according to claim 1, wherein after growing the said nuclei at least one conversion step is performed, wherein converting the said emulsion grains is performed by adding silver iodide microcrystals having an average crystal size of at most 0.05 $\mu$m.

15. Method according to claim 1, wherein during and after growing the said nuclei at least one conversion step is performed, wherein converting the said emulsion grains is performed by adding silver iodide microcrystals having an average crystal size of at most 0.05 $\mu$m.

16. Method according to claim 8, wherein by converting the said emulsion grains the said emulsion comprises tabular grains having a variable iodide profile, in that the grains have been enriched in iodide at the crystal surface, said profile being characterized by the presence of iodide ions in the crystal volume in lower amounts than at the crystal surface of the said tabular grains and in that an amount of 50 to 100 mole % of the total amount of iodide ions is located at the surface of said tabular grains.

17. Method according to claim 11, wherein by converting the said emulsion grains the said emulsion comprises tabular grains having a variable iodide profile, in that the grains have been enriched in iodide at the crystal surface, said profile being characterized by the presence of iodide ions in the crystal volume in lower amounts than at the crystal surface of the said tabular grains and in that an amount of 50 to 100 mole % of the total amount of iodide ions is located at the surface of said tabular grains.

18. Method according to claim 14, wherein by converting the said emulsion grains the said emulsion comprises tabular grains having a variable iodide profile, in that the grains have been enriched in iodide at the crystal surface, said profile being characterized by the presence of iodide ions in the crystal volume in lower amounts than at the crystal surface of the said tabular grains and in that an amount of 50 to 100 mole % of the total amount of iodide ions is located at the surface of said tabular grains.

19. Silver halide emulsion comprising silver chlorobromoiodide or silver chloroiodide tabular grains with at least 75 mole % of chloride and from 0.1 up to 3 mole % of iodide, based on silver, further having {111} crystal faces, an average aspect ratio of at least 2:1, with at least 75% of the total projected area of all grains being provided by said tabular grains and with a variation coefficient on sphere equivalent diameter (SED) of all grains being lower than 0.30 prepared by the method of claim 1.

* * * * *